US005170543A

United States Patent [19]

Duncan

[11] Patent Number: 5,170,543

[45] Date of Patent: Dec. 15, 1992

[54] PIN TENTER CLAMP WITH STRIPPER PLATE

[75] Inventor: Jeffrey B. Duncan, Argyle, N.Y.

[73] Assignee: Albany International Corp., Albany, N.Y.

[21] Appl. No.: 913,016

[22] Filed: Jul. 14, 1992

[51] Int. Cl.[5] ..... D06C 3/04

[52] U.S. Cl. ..... 26/95; 269/54.3

[58] Field of Search ..... 26/89, 93, 94, 95, 96, 26/88; 34/158, 162, 163; 269/53, 54.1, 54.2, 54.3, 157, 54, 161, 259, 274, 239; 24/353, 354, 355

[56] References Cited

U.S. PATENT DOCUMENTS

| | | | |
|---|---|---|---|
| 1,050,755 | 1/1913 | Whitley | 26/95 |
| 1,152,239 | 8/1915 | Thom | 269/161 |
| 2,760,251 | 8/1956 | Kirkpatrick | 26/95 |
| 2,815,777 | 12/1957 | Iraids | 269/54.3 |
| 3,744,107 | 7/1973 | Mitchell | 26/95 |
| 4,403,379 | 9/1983 | Grafen | 26/95 |
| 4,834,352 | 5/1989 | Thornton | 269/274 |
| 4,982,593 | 1/1991 | Holloway | 269/274 |

FOREIGN PATENT DOCUMENTS

| | | | |
|---|---|---|---|
| 1126351 | 3/1962 | Fed. Rep. of Germany | 26/96 |
| 64683 | 11/1968 | Fed. Rep. of Germany | 26/95 |
| 2153734 | 10/1971 | Fed. Rep. of Germany | 26/96 |
| 374780 | 6/1932 | United Kingdom | 24/355 |

*Primary Examiner*—Andrew M. Falik
*Assistant Examiner*—Amy Brooke Vanatta
*Attorney, Agent, or Firm*—Kane, Dalsimer, Sullivan, Kurucz, Levy, Eisele and Richard

[57] ABSTRACT

A pin tenter clamp for a tenter apparatus has a clamp base on which tenter pins are disposed. The clamp base is provided with a hinge about which a clamp top plate is pivotable. A resilient, elastomeric clamp pad is disposed on a side of the clamp top plate facing the clamp base and tenter pins. The clamp top plate is biased away from the clamp base to open the pin tenter clamp. Between the clamp top plate and clamp base is a stripper plate having openings through which the tenter pins may extend when the pin tenter clamp is closed. The stripper plate also has a resilient, elastomeric clamp pad having openings aligned with those in the stripper plate. When the pin tenter clamp is open, the stripper plate resides above the tenter pins. In use on a tenter apparatus, the present pin tenter clamp first holds the fabric to be stretched between the resilient, elastomeric clamp pads before the tenter pins may extend threrethrough. As the pin tenter clamp is gradually opened after the stretching of the fabric, the resilient, elastomeric clamp pads hold the fabric while the tenter pins are withdrawn, and release the fabric only after this has taken place.

12 Claims, 3 Drawing Sheets

FIG. 5
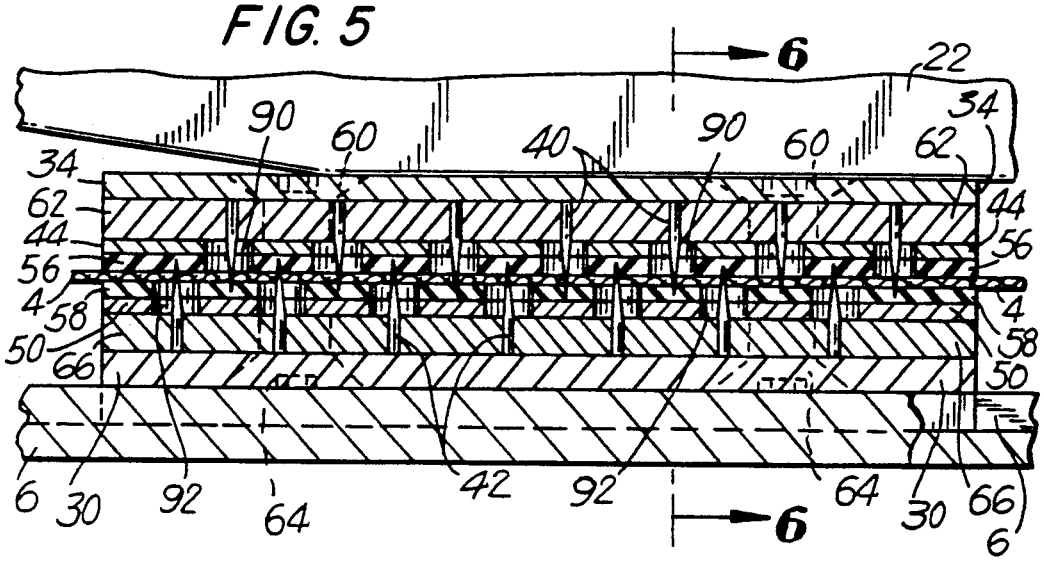
FIG. 6
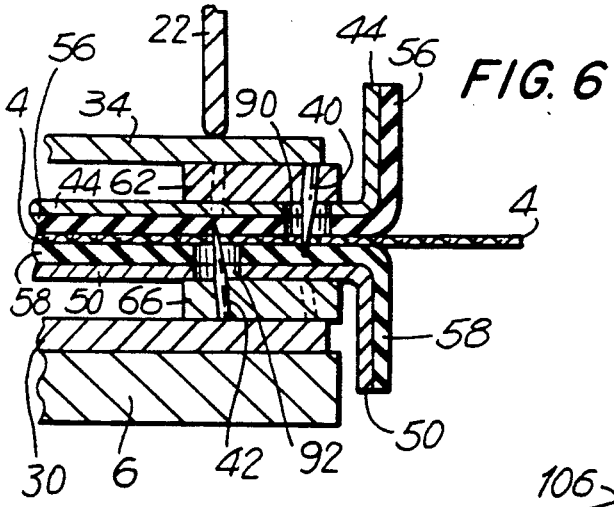
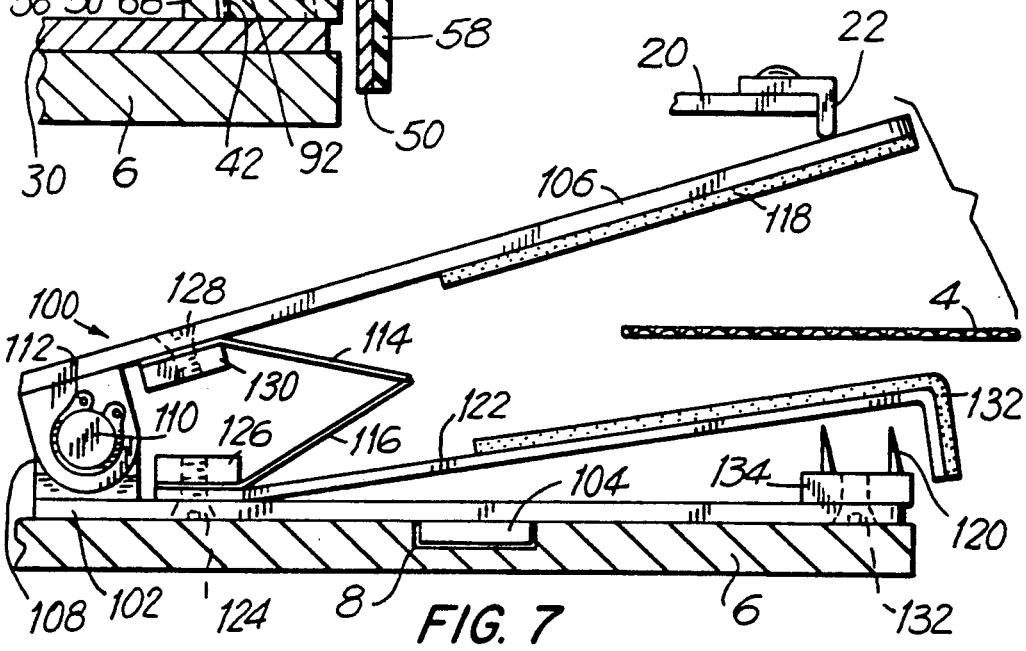
FIG. 7

PIN TENTER CLAMP WITH STRIPPER PLATE

BACKGROUND OF THE INVENTION

1. Field of the Invention

The present invention relates generally to the clamps used to hold the lengthwise edges of a fabric, web, or sheet to be stretched in a tenter apparatus, and more specifically to those which use tenter pins to hold those edges.

2. Description of the Prior Art

Tenter apparatus and their associated pin plates are well known in the art. Standard pin plates consist& of a bed plate having rows of sharp pins protruding at a slight angle from a direction perpendicular to the bed plate and in the direction the fabric is to be stretched. The fabric is typically pressed onto these pins by means of a rotating brush.

In practice, a plurality of the bed plates are arranged to follow an endless conveyor track, or raceway, opposite a similar conveyor track. At the point where the fabric to be stretched on the tenter apparatus is introduced, the conveyor tracks are separated by a distance approximately equal to that of the width of the fabric. From that point, the conveyor tracks proceed parallel to one another for a predetermined distance, then diverge from one another by an amount equal to the degree of transverse stretching desired. The stretching may take place while the tenter apparatus is conveying the fabric through a heating zone. Longitudinal stretching may be accomplished at the same time by providing the endless conveyor tracks with means for separating adjacent bed plates on each track from one another while the tracks are diverging. In any event, after the fabric has been stretched in the transverse, and perhaps longitudinal, direction, the endless conveyor tracks again take on directions parallel to one another, although now more widely separated. At the end of the tenter apparatus, of course, the fabric, now stretched, is removed from the tenter pins.

Alternatively, the conveyor tracks may remain parallel to one another and separated by a constant amount for the entire length of the tentering apparatus. In such a situation, the tentering apparatus is used to prevent shrinkage while the tentered fabric is being conveyed through a heating, or other treatment, zone.

One serious difficulty with pin tentering is that the fabric tension load on the tenter apparatus is poorly distributed because it is carried only at those points where a pin penetrates the fabric. In addition, the edge of the fabric may suffer damage as the pin is removed after the fabric has been stretched, if the fabric remains under tension when this is being done.

The purpose of the present invention is to eliminate and overcome these serious difficulties in the prior art by providing a pin tenter clamp which clamps the fabric and maintains it under tension while the tenter pins are inserted and retracted therefrom, and which prevents the fabric from slipping off the tenter pins.

SUMMARY OF THE INVENTION

Accordingly, the present invention reduces or eliminates the above-mentioned problems by providing a pin tenter clamp having a clamp top plate mounted pivotally by a hinge means on what has been referred to above as the bed plate, but will be referred to herein below as the clamp base. At least one row of tenter pins, which are inclined slightly from the perpendicular toward the hinge means, is disposed along the edges of both the clamp top plate and the clamp base farthest from the hinge means. Two stripper plates, each provided with a resilient, elastomeric clamp pad, are disposed in the space between the clamp top plate and the clamp base, and reside below, and above, the tenter pins on the clamp top plate, and clamp base, respectively. The stripper plates are provided with openings, such as holes, as are their respective resilient, elastomeric clamp pads, through which the tenter pins may extend when the pin tenter clamp is fully closed. The resilient, elastomeric clamp pads face one another, so that they together may grasp a fabric to be tentered as the pin tenter clamp is being closed, and before the tenter pins on the clamp top plate and clamp base penetrate the fabric. Biasing means, which act to restore the pin tenter clamp to an open position when a closing force is removed, are also provided.

More specifically, when the present pin tenter clamp begins to close onto the fabric to be tentered, and perhaps stretched, the fabric is first grabbed between the resilient, elastomeric clamp pads on the two stripper plates. As the pin tenter clamp closes further, the stripper plates are depressed until the tenter pins extend therethrough and penetrate the fabric. When the pin tenter clamp is fully closed, the two stripper plates are depressed as much as possible against their respective clamp top plate or clamp base. At that point, the resilient, elastomeric clamp pads are also compressed, spreading the tension load on the fabric over an area around the pins.

Several embodiments of the present pin tenter clamp will now be described in more complete detail in the discussion to follow, wherein reference will frequently be made to the illustrative figures identified below.

BRIEF DESCRIPTION OF THE DRAWINGS

FIG. 5 is a cross-sectional view of the pin tenter clamp taken as indicated by line 5—5 in FIG. 4.

FIG. 6 is a cross-sectional view of the pin tenter clamp taken as indicted by line 6—6 in FIG. 5.

FIG. 7 is a side view, analogous to that presented in FIG. 2, of an alternate embodiment of the pin tenter clamp of the present invention.

DETAILED DESCRIPTION OF THE PREFERRED EMBODIMENTS

Figure 1:
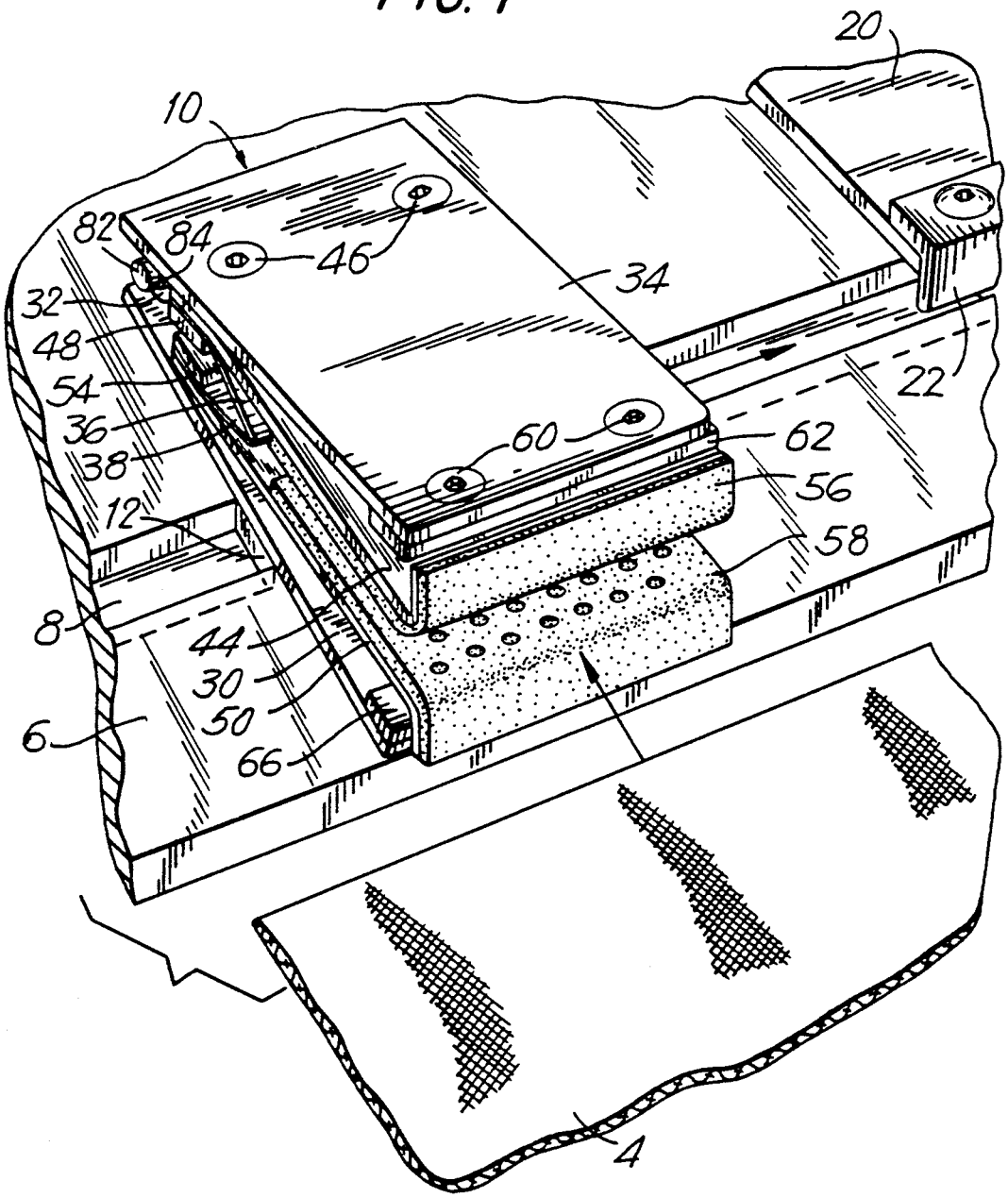
FIG. 1 shows a perspective view of the pin tenter clamp of the present invention on the conveyor track of a tentering apparatus.

Turning first to FIG. 1, a perspective view of the pin tenter clamp 10 of the present invention on a conveyor track 6 of a tentering apparatus is presented. The conveyor track 6 has a guide slot 8 into which a guide 12 on the underside of the pin tenter clamp 10 may fit, so that the pin tenter clamp 10 may be guided around the conveyor track 6, which, though not shown in FIG. 1, is endless. The conveyor track 6, guide slot 8, and guide 12, as well as the tenter frame top plate 20 and clamping wedge 22, whose functions will be described below, are not part of the pin tenter clamp 10 of the present invention. A fabric 4 to be tentered is held within the pin tenter clamp 10, as implied by the arrow in FIG. 1, while it is conveyed through the tentering apparatus. Although FIG. 1 shows only one pin tenter clamp 10, a tentering apparatus include a plurality of such clamps 10 on each of its endless conveyor tracks.

Figure 2:
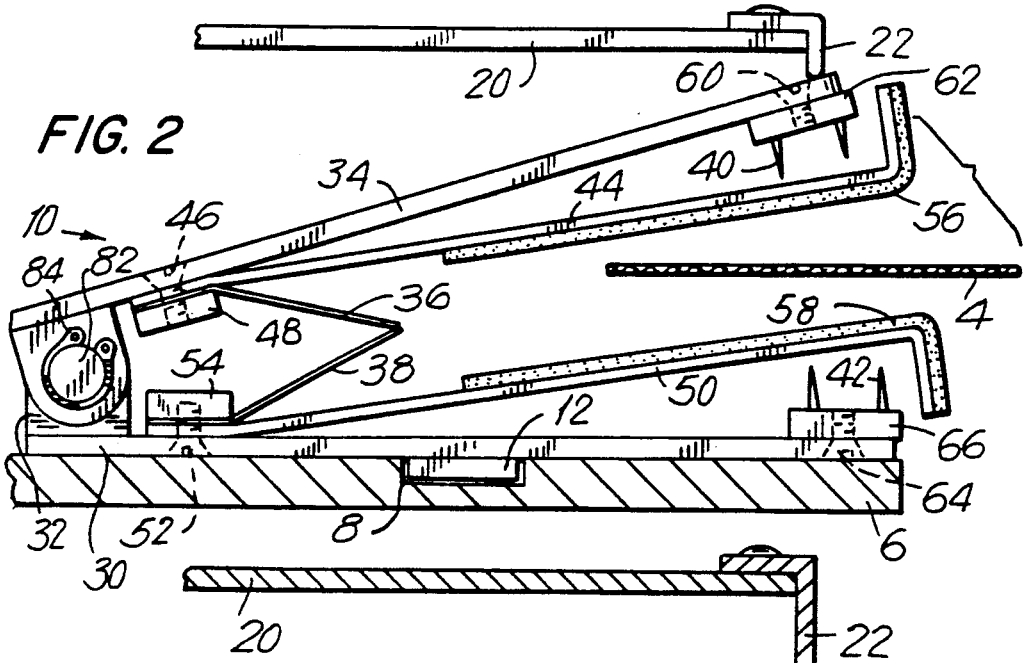
FIGS. 2 through 4 show side views of the pin tenter clamp on the conveyor track of a tentering apparatus when open, partially closed, and fully closed, respectively.
Figure 3:
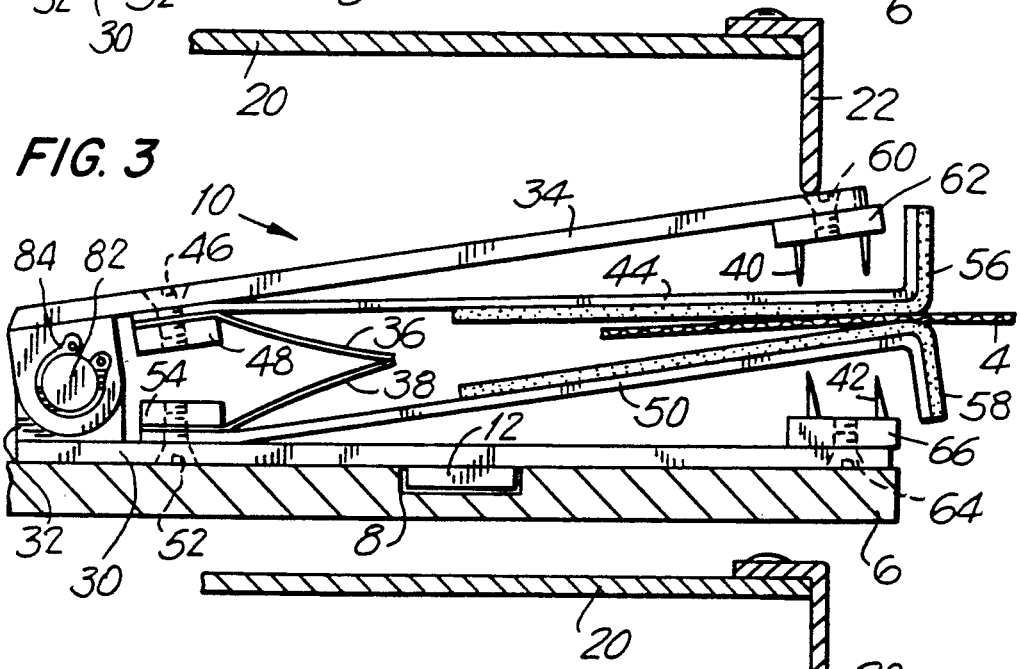
Figure 4:
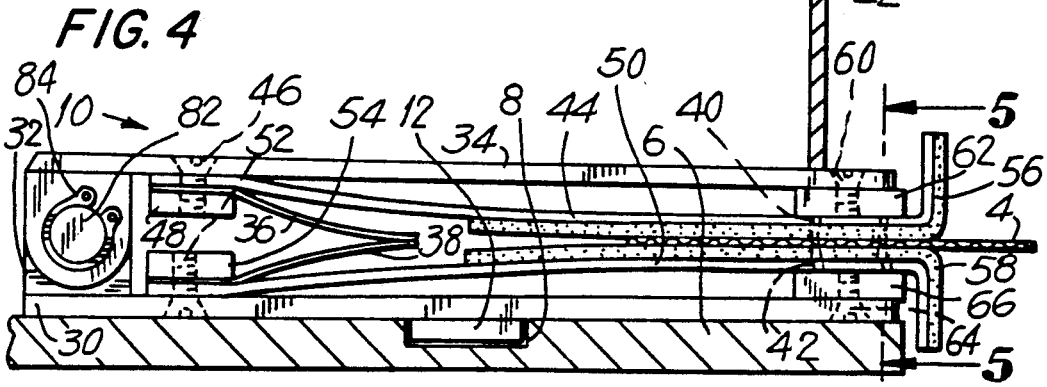

FIGS. 2 through 4 are side views of the pin tenter clamp 10 taken at three different positions on one of the endless conveyor tracks 6 of a tentering apparatus. Referring specifically to FIG. 2, the pin tenter clamp 10 comprises a clamp base 30, which was referred to as a bed plate in the discussion above. The clamp base 30 includes a hinge 32. A clamp top plate 34 is pivotable about hinge 32, and is biased toward an open position by biasing means, which may be a pair of opposing leaf springs 36,38. A first leaf spring 36 is attached to the clamp top plate 34, while a second leaf spring 38 is attached to the clamp base 30. The two leaf springs 36,38 remain in contact with one another at all times, and provide the force required to hold point tenter clamp 10 open when it is not in the active tentering region.

A first plurality of tenter pins 40, which may be arranged in more than one row, is disposed on the clamp top plate 34. A second plurality of tenter pins 42, which may also be arranged in more than one row, is disposed on the clamp base 30. Both of said pluralities are disposed at an angle inclined toward the hinge 32 from direction perpendicular to the clamp top plate 34 (for the first plurality of tenter pins 40) o the clamp base 30 (for the second plurality of tenter pins 42).

In the pin tenter clamp 10 of the present invention, there are two stripper plates. The first stripper plate 44 is a plate-like leaf spring disposed between the clamp base 30 and the clamp top plate 34, and adjacent to the clamp top plate 34. The first stripper plate 44 resides below the first plurality of tenter pins 40 when the pin tenter clamp 10 is open, as shown in FIG. 2. First stripper plate 44 is a provided with a plurality of openings to permit the first plurality of tenter pins 40 to pass therethrough when pin tenter clamp 10 is closed. The first stripper plate 44 may be attached to clamp top plate 34 by screws 46 passing therethrough and engaging within plate 48. The first leaf spring 36 may also be attached to the clamp top plate 34 by screws 46 and plate 48. Alternatively, the first stripper plate 44 could be a rigid plate biased away from the clamp top plate 34 by separate springs.

The second stripper plate 50 is another plate-like leaf spring disposed between the clamp base 30 and the clamp top plate 34, and adjacent to the clamp base 30. The second stripper plate 50 resides above the second plurality of tenter pins 42 when the pin tenter clamp 10 is open, as shown in FIG. 2. Second stripper plate 50 is provided with a plurality of openings to permit the second plurality of tenter pins 42 to pass therethrough when pin tenter clamp 10 is closed. The second stripper plate 50 may be attached to the clamp base 30 by screws 52 passing therethough and engaging within plate 54. The second leaf spring 38 may also be attached to the clamp base 30 by screws 52 and plate 54. Alternatively, the second stripper plate 50 could be a rigid plate biased away from clamp base 30 by separate springs.

Both the first stripper plate 44 and the second stripper plate 50 are provided with resilient, elastomeric clamp pads. A first resilient, elastomeric clamp pad 56 on first stripper plate 44 faces a second resilient, elastomeric clamp pad 58 on second stripper plate 50. That is to say, the first resilient, elastomeric clamp pad 56 is on a side of first stripper plate 44 facing clamp base 30, while the second resilient, elastomeric clamp pad 58 is on a side of second stripper plate 50 facing clamp top plate 34. Both the first resilient, elastomeric clamp pad 56 and the second resilient, elastomeric clamp pad 58 may be provided with a plurality of openings corresponding to those in their respective first stripper plate 44 and second stripper plate 50, so that the first and second pluralities of tenter pins 40,42 may pass therethrough when pin tenter clamp 10 is closed.

In addition, both the first resilient, elastomeric clamp pad 56 and the second resilient, elastomeric clamp pad 58 may be provided with additional openings to accommodate the second and first pluralities of tenter pins 42,40 when pin tenter clamp 10 is closed. That is to say, each resilient, elastomeric clamp pad may be provided with openings to accommodate the opposite tenter pins when the pin tenter clamp 10 is closed.

The clamp pads may be of red (iron-oxide loaded) silicone rubber. In practice, any material having the following properties may be used: resilience, resistance to taking a set, even at high temperatures and after many cycles, and a high coefficient of friction.

The first plurality of tenter pins 40 may be mounted under the clamp top plate 34 by screws 60 passing therethrough and engaging within plate 62. Similarly, the second plurality of tenter pins 42 may be mounted upon the clamp base 30 by screws 64 passing therethrough and engaging within plate 66.

It should be observed that pin tenter clamp 10, being provided with two resilient, elastomeric clamp-pad bearing stripper plates, can firmly hold a fabric being tentered. FIGS. 2 through 4 show the sequence by which the pin tenter clamp 10 closes onto the edge of a fabric 4. In FIG. 2, the edge of the fabric 4 is shown inserted in the open pin tenter clamp 10. In a view taken at a later point in the endless conveyor track of the tenter apparatus, shown in FIG. 3, the clamping wedge 22 is longer, having gradually increased in thickness between the points shown in FIGS. 2 and 3. The clamping wedge 22, as a consequence, forces the clamp top plate 34 down against the force provided by the first and second opposed leaf springs 36,38, and clamps the edge of the fabric 4 between the first and second resilient, elastomeric clamp pads 56,58. The fabric 4 is thereby clamped before the first and second pluralities of tenter pins 40,42 emerge through the openings in the first and second stripper plates 44,50 provided therefor.

Finally, pin tenter clamp 10 is shown fully closed in FIG. 4, where the thickness of the clamping wedge 22 is at its greatest. At that point, the first and second pluralities of tenter pins 40,42 penetrate the fabric 4, yet do not carry the full tension load across the fabric 4 because both the first and second resilient, elastomeric clamp pads 56,58 are compressed, spreading the tension load over an area around the first and second pluralities of tenter pins 40,42.

When the stretching of the fabric 4 on the tenter apparatus has been concluded, the sequence shown in FIGS. 2 through 4 occurs in reverse. Most importantly, the first and second pluralities of tenter points 40,42 are withdrawn from fabric 4, while the fabric 4 remains clamped between the first and second resilient, elastomeric clamp pads 56,58, reducing the occurrence of damage to the fabric 4 which may accompany such removal.

Before concluding the present discussion of FIGS. 2 through 4, hinge 32 may be an integral part of clamp base 30 and clamp top plate 34, both of which are held together in the form of hinge 32 by hinge pin 82. Hinge pin 82 is itself held in position, and prevented from slipping out, by retainer 84.

FIG. 5 is a cross-sectional view of the pin tenter clamp taken as indicated by line 5—5 in FIG. 4. As may be seen, pin tenter clamp 10 is in a fully closed position, as a consequence of being conveyed on conveyor track 6 to a point where clamping wedge 22 is at its greatest thickness. Fabric 4 is clamped between the first and second resilient, elastomeric clamp pads 56,58, and the first and second pluralities of tenter pins 40,42 protrude through openings in the first and second stripper plates 44,50 and through the first and second resilient, elastomeric clamp plates 56,58. More specifically, the first plurality of tenter pins 40 pass through aligned openings 90 in the first stripper plate 44 and the first resilient, elastomeric clamp pad 56, penetrate fabric 4 and pierce the surface of second resilient, elastomeric clamp pad 58. If desired, small holes may be provided in the surface of second resilient, elastomeric clamp pad 58 at those points where the second plurality of tenter pins 40 would otherwise pierce it.

In like manner, the second plurality of tenter pins 42 pass through aligned openings 92 in the second stripper plate 50 and the second resilient, elastomeric clamp pad 56, penetrate fabric 4 and pierce the surface of first resilient, elastomeric clamp pad 56. If desired, small holes may be provided in the surface of first resilient, elastomeric clamp pad 56 at those points where the second plurality of tenter pins 42 would otherwise pierce it.

FIG. 6 is a cross-sectional view of the pin tenter clamp taken as indicated by line 6—6 in FIG. 5. There, it is apparent that the first and second pluralities of tenter pins 40,42 are inclined slightly from directions perpendicular to the clamp top plate 34 and clamp base 30 toward the hinge 32. It will also be apparent that the first and second stripper plates 44,50, and their respective first and second resilient, elastomeric clamp pads 56,58, diverge from one another beyond the edges of the clamp top plate 34 and clamp base 30, that is, to the right of the first and second pluralities of tenter pins 40,42. Advantageously, they may diverge from one another by 180° as a consequence of first stripper plate 44 being bent upward by 90° and second stripper plate 50 being bent downward by 90°. As may be particularly noted in FIG. 2, this feature makes it more difficult to insert the fabric 4 to be tentered anywhere but into the space in the open pin tenter clamp 10 between the first stripper plate 44 and the second stripper plate 50.

A side view of an alternate embodiment of the pin tenter clamp of the present invention is presented in FIG. 7. Several elements shown in FIG. 7 which are not part of the alternative embodiment of the pin tenter clamp 100 are identified in FIG. 7 with the same reference numerals as were previously used. Specifically, the pin tenter clamp 100 is conveyed around endless conveyor track 6, which has a guide slot 8. The tentering apparatus includes tenter frame top plate 20 and clamping wedge 22. Fabric 4 is grasped by pin tenter clamp 100 in order to be tentered.

The pin tenter clamp 100 comprises a clamp base 102 having, on its underside, a guide 104 which fits into the guide slot 8 on endless conveyor track 6. Clamp top plate 106 is pivotable about hinge 108 with respect to clamp base 102. The hinge 108 may be an integral part of clamp base 102 and clamp top plate 106, both of which are held together in the form of a hinge 108 by hinge pin 110. Hinge pin 110 is itself held in position, and prevented from slipping out, by retainer 112.

Clamp top plate 106 is biased toward an open position by biasing means, which may be a pair of opposing leaf springs 114,116. A first leaf spring 114 is attached to the clamp top plate 106, while a second leaf spring 116 is attached to the clamp base 102. The two leaf springs 114,116 remain in contact with each other at all times, and provide the force required to hold pin tenter clamp 100 open when it is not in the active tentering region.

A resilient, elastomeric clamp pad 118 is disposed on a side of the clamp top plate 106 facing the clamp base 102.

A plurality of tenter pins 120, which may be arranged in more than one row, is disposed on the clamp base 102. As before, the plurality of tenter pins 120 is disposed at an angle inclined toward the hinge 108 from a direction perpendicular to the clamp base 102.

In pin tenter clamp 100, there is one stripper plate 122 above the plurality of tenter pins 120. The stripper plate 122 is a plate-like leaf spring disposed between the clamp base 102 and the clamp top plate 106, and adjacent to the clamp base 102. The stripper plate 122 is provided with a plurality of openings to permit the plurality of tenter pins 120 to pass therethrough when pin tenter clamp 100 is closed. The stripper plate 122 ma be attached to the clamp base 102 by screws 124 passing therethrough and engaging within plate 126. The second leaf spring may also be attached to the clamp base 102 by screws 124 and plate 126. Alternatively, stripper plate 122 could be a rigid plate biased away from clamp base 102 by separate springs.

The first leaf spring 114 may be attached to the clamp top plate 106 by screws 128 passing therethrough and engaging within plate 130.

Like the clamp top plate 106, the stripper plate 122 has a resilient, elastomeric clamp pad 132. Resilient, elastomeric clamp pad 132 faces resilient, elastomeric clamp pad 118, and has a plurality of openings aligned with those in stripper plate 122, so that the plurality of pins 120 may pass therethrough when pin tenter clamp 100 is fully closed. Resilient, elastomeric clamp pad 118 may be provided with holes in places where it would otherwise be pierced by plurality of pins 120 when pin tenter clamp 100 is fully closed.

The plurality of tenter pins 120 may be mounted upon the clamp base 102 by screws 132 passing therethrough and engaging within plate 134.

It finally bears repeating that when the fabric 4 has been stretched on the tenter apparatus to the desired amount, or after the fabric 4 has been conveyed through a treatment zone under widthwise tension to prevent shrinkage, the pin tenter clamps 10,100 release the fabric 4 in a sequence opposite to that shown in FIGS. 2 through 4. That is to say, as an individual pin tenter clamp 10,100 progresses around the endless conveyor track, or raceway, of the tenter apparatus, clamping wedge 22 becomes gradually less thick at the point where the fabric 4 is to be released. The opposed leaf springs are then able to open pin tenter clamps 10,100. While this is occurring, the stripper plate, or plates, gently remove the fabric 4 from the tenter pins, as the fabric 4 remains held between the stripper plate, or plates, and resilient, elastomeric clamp pads. The stripper plates are appropriately named, because they "strip" the fabric 4 from the tenter pins before the pin tenter clamp 10,100 is completely opened. The fabric 4 is released only after the tenter pins have been completely withdrawn therefrom. This reduces the possibility of damage to the edges of the fabric 4 being tentered, which damage may occur when the tenter pins alone bear the tension across the fabric.

Modifications to the above would be obvious to those skilled in the art without bringing the invention so modified beyond the scope of the appended claims.

What is claimed is:

1. A pin tenter clamp for a tenter used to stretch a fabric, web, or sheet, said pin tenter clamp comprising:

a clamp base;

a hinge on said clamp base;

a clamp top plate, said clamp top plate being pivotable about said hinge on said clamp base;

means for biasing said clamp top plate about said hinge in a direction away from said clamp base to open said pin tenter clamp;

a resilient, elastomeric clamp pad disposed on a side of said clamp top plate facing said clamp base;

a plurality of tenter pins, said plurality being disposed on said clamp base at an angle inclined toward said hinge from a direction perpendicular to said clamp base; and a stripper plate, said stripper plate being disposed between said clamp base and said clamp top plate above said plurality of tenter pins when said pin tenter clamp is open, said stripper plate having a plurality of openings to permit said plurality of tenter pins to pass therethrough when said pin tenter clamp is closed, said stripper plate being attached to said clamp base and biased toward said clamp top plate.

2. A pin tenter clamp as claimed in claim 1 wherein said means for biasing said clamp top plate is a first and a second leaf spring, said first leaf spring being attached to said clamp top plate and said second leaf spring being attached to said clamp base, said first and second leaf springs acting upon one another to open said pin tenter clamp.

3. A pin tenter clamp as claimed in claim 1 wherein said resilient, elastomeric clamp pad on said clamp top plate has a plurality of openings to accommodate said plurality of tenter pins when said pin tenter clamp is closed.

4. A pin tenter clamp as claimed in claim 1 further comprising a second resilient, elastomeric clamp pad, said second resilient, elastomeric clamp pad being disposed on a side of said stripper plate facing said clamp top plate, said second resilient, elastomeric clamp pad being provided with a plurality of openings corresponding to said plurality of openings in said stripper plate, so that said plurality of tenter pins may pass therethrough when said pin tenter clamp is closed.

5. A pin tenter clamp as claimed in claim 1 wherein said stripper plate is a plate-like leaf spring.

6. A pin tenter clamp as claimed in claim 1 wherein said resilient, elastomeric clamp pad is made from red silicone rubber.

7. A pin tenter clamp for a tenter used to stretch a fabric, web, or sheet, said pin tenter clamp comprising:

a clamp base;

a hinge on said clamp base;

a clamp top plate, said clamp top plate being pivotable about said hinge on said clamp base;

means for biasing said clamp top plate about said hinge in a direction away from said clamp base to open said pin tenter clamp;

a first plurality of tenter pins, said firs&. plurality being disposed on said clamp top plate at an angle inclined toward said hinge from a direction perpendicular to said clamp top plate;

a second plurality of tenter pins, said second plurality being disposed on said clamp base at an angle inclined toward said hinge from a direction perpendicular to said clamp base;

a first stripper plate, said first stripper plate being disposed between said clamp base and said clamp top plate adjacent to s id clamp top plate and below said first plurality of tenter pins when said pin tenter clamp is open, said first stripper plate having a plurality of openings to permit said first plurality of tenter pins to pass therethrough when said pin tenter clamp is closed, said first stripper plate being attached to said clamp top plate and biased toward said clamp base;

a first resilient, elastomeric clamp pad, said first resilient, elastomeric clamp pad being disposed on a side of said first stripper plate facing said clamp base, said first resilient, elastomeric clamp pad being provided with a plurality of openings corresponding to said plurality of openings in said first stripper plate, so that said first plurality of tenter pins may pass therethrough when said pin tenter clamp is closed;

a second stripper plate, said second stripper plate being disposed between said clamp base and said clamp top plate adjacent to said clamp base and above said second plurality of tenter pins when said pin tenter clamp is open, said second stripper plate having a plurality of openings to permit said second plurality of tenter pins to pass therethrough when said pin tenter clamp is closed, said second stripper plate being attached to said clamp base and biased toward said clamp top plate; and a second resilient, elastomeric clamp pad, said second resilient, elastomeric clamp pad being disposed on a side of said second stripper plate facing said clamp top plate, said second resilient, elastomeric clamp pad being provided with a plurality of openings corresponding to said plurality of openings in said second stripper plate, so that said second plurality of tenter pins may pass therethrough when said pin tenter clamp is closed.

8. A pin tenter clamp as claimed in claim 7 wherein said means for biasing said clamp top plate are a first and a second leaf spring, said first leaf spring being attached to said clamp top plate and said second leaf spring being attached to said clamp base, said first and second leaf springs acting upon each other to open said pin tenter clamp.

9. A pin tenter clamp as claimed in claim 7 wherein said first resilient, elastomeric clamp pad on said first stripper plate has a plurality of openings to accommodate said second plurality of tenter pins when said pin tenter clamp is closed.

10. A pin tenter clamp as claimed in claim 7 wherein said second resilient, elastomeric clamp pad on said second stripper plate has a plurality of openings to accommodate said first plurality of tenter pins when said pin tenter clamp is closed.

11. A pin tenter clamp as claimed in claim 7 wherein said first and second stripper plates are plate-like leaf springs.

12. A pin tenter clamp as claimed in claim 7 wherein said first and second resilient, elastomeric clamp pads are made from red silicone rubber.

* * * * *